United States Patent [19]

Salmon et al.

[11] 3,932,442

[45] Jan. 13, 1976

[54] PROCESS FOR SCREENING MATERIALS WITH VIBRATING SCREENS

[75] Inventors: John Kennedy Salmon, Glen Cove; Richard A. Adie, Hauppauge, both of N.Y.

[73] Assignee: Lundy Electronics & Systems, Inc., Glen Head, N.Y.

[22] Filed: Aug. 27, 1973

[21] Appl. No.: 392,012

[52] U.S. Cl. ..... 209/309; 209/368; 210/385

[51] Int. Cl.[2] ..... B07H 1/36

[58] Field of Search ..... 209/346, 366.5, 332, 368, 209/365 R, 365 A, 365 B, 363, 237, 309; 198/220; 210/388, 389, 385

[56] References Cited

UNITED STATES PATENTS

| | | | |
|---|---|---|---|
| 546,241 | 9/1895 | McAnulty | 209/332 X |
| 2,746,598 | 5/1956 | Sherwen | 209/368 X |
| 3,047,151 | 7/1962 | Hurst | 209/332 X |
| 3,258,111 | 6/1966 | Spurlin | 198/220 BC |
| 3,322,260 | 5/1967 | Schwenzfeier | 209/368 X |
| 3,655,032 | 4/1972 | Willis | 198/220 BC |
| 3,680,683 | 8/1972 | Lebreuil | 198/220 DC |
| 3,771,644 | 11/1973 | Mufli | 198/220 BC |

FOREIGN PATENTS OR APPLICATIONS

| | | | |
|---|---|---|---|
| 1,012,149 | 7/1957 | Germany | 209/309 |

*Primary Examiner*—Robert Halper
*Attorney, Agent, or Firm*—Brumbaugh, Graves, Donohue & Raymond

[57] ABSTRACT

A process for screening materials as a function of particle size differences by feeding the materials onto one side of a substantially planar screen and vibrating the screen by producing a translational screen oscillation in directions normal to the screen plane and a torsional screen oscillation about an axis normal to the screen plane so that each point of the screen moves in a helical path. Screened material is collected at the other side of the screen and screened retentate is transported by the torsional screen oscillation to an exit port at a location spaced from the axis of torsional oscillation.

The process is particularly applicable to shipboard or other mobile use, since the spring stiffness provides good structural support under tilt or side acceleration conditions.

6 Claims, 7 Drawing Figures

PROCESS FOR SCREENING MATERIALS WITH VIBRATING SCREENS

The use of screens to separate solids from liquids, particularly solids suspended in liquids or to classify solids either in the dry form or suspended in liquids according to some predetermined size, represents techniques which have been practiced from historic times. The variety of materials which can be separated by screening techniques is enormous. Throughout this specification the terms solids separating or solids screening processes will be used to include both wet and dry screening processes or combinations of these processes.

Generally the use of screening techniques has been applied to many complex problems. In many cases screen blockage by the solids has occurred. This blockage or blinding tendency of many solids has prevented the use of many screening processes, and the extension of these solids screening processes to many materials has required the use of vibrating screens. Usually the vibrating screens have been driven by either of two general methods.

In one method the screen is mounted on some form of soft spring and the vibration imparted by a rotating unbalanced mass. There are many permutations and combinations of this method which have been disclosed. The movement of the screen in this type of vibration is very complex and is usually characterized by a wobble. The acceleration of the screen normal to its own plane is generally a function of the location on the screen. Thus, zones on the screen are found which operate at low vibration levels in this direction. The second general method of vibrating the screen uses some form of mechanical drive such as a cam, guides or the like. Usually such screens are driven at low frequency and occasionally the amplitude is relatively high. In both cases additional vibration is achieved in a random fashion by impacting the screen with resilient materials such as rubber balls or the like.

With the vibrating screens of the above type, several general limitations are encountered. Frequently, solids will adhere to the screen and are not induced to separate from the screen since there is no rapid acceleration normal to the screen surface. In many instances surface characteristics of the particles are such that particles adhering to the screen will tend to agglomerate with other particles and in a very short time a major portion of the screen surface will be blocked. In separating solids from liquids, particularly if a fine screen is used, surface tension forces and the viscous characteristics of many liquids extends these problems. The build up of solid particles on the screen exaggerates these effects and the flow of liquids through such screens is correspondingly reduced. In many cases screen blinding, especially in removing slimes from liquids, or in classifying powders which pack readily, frequently occurs and the reduced throughput and downtime impairs efficiency drastically.

In many cases the methods of driving the screens cause serious secondary problems. In mechanical drives the screens and related holders are subjected to severe mechanical action and as a result, the construction of these units must be very heavy. This increases the driving force required and frequent failure of parts occurs. On large installations this has become a serious problem and requires the use of heavy structures to prevent early failure. The mechanical drives frequently transmit vibrations to the buildings and hence increase building and especially foundation costs. Maintenance of mechanical drives is usually high since the moving parts rub or turn against each other and the constant jarring action cause rapid deterioration of equipment. On large installations noise levels and the accompanying vibration levels are frequently high and are injurious to employee health and morale. This is an increasingly important factor as the damage to the health of operators from long term exposure to high noise levels is recognized.

The vibration screens mounted on soft springs with their complex mode of vibration, which may be characterized as a wobble, suffer from another characteristic limitation. The complex nature of their response to excitation requires care in feeding to prevent additional vibrations which could start short circuiting of feed before it has had sufficient time to be screened properly. In addition, the soft type of spring support with little support of the screen in either direction parallel to the screen surface, makes such screens impractical for those applications where the support may be subjected to some relatively uncontrolled motion. Thus, attempts to use such vibrating screens on shipboard to segregate certain waste products or for other uses have been of little practicality.

One of the objects of this invention is to provide a process for separating solids from liquids and for classifying solids, which uses a vibrating screen with greatly improved blinding characteristics. Another object is to separate solids from liquids and for classifying solids which uses vibrating screens with greatly reduced noise and vibration transmission characteristics. A further object of the invention is to provide a process for the above separations in which the separating efficiency is very greatly improved and which can operate for long periods of time. A still further object of the invention is to provide a vibrating screen process which can be used effectively on shipboard. Other objects of this invention will be apparent to those skilled in the art.

Figure 2:
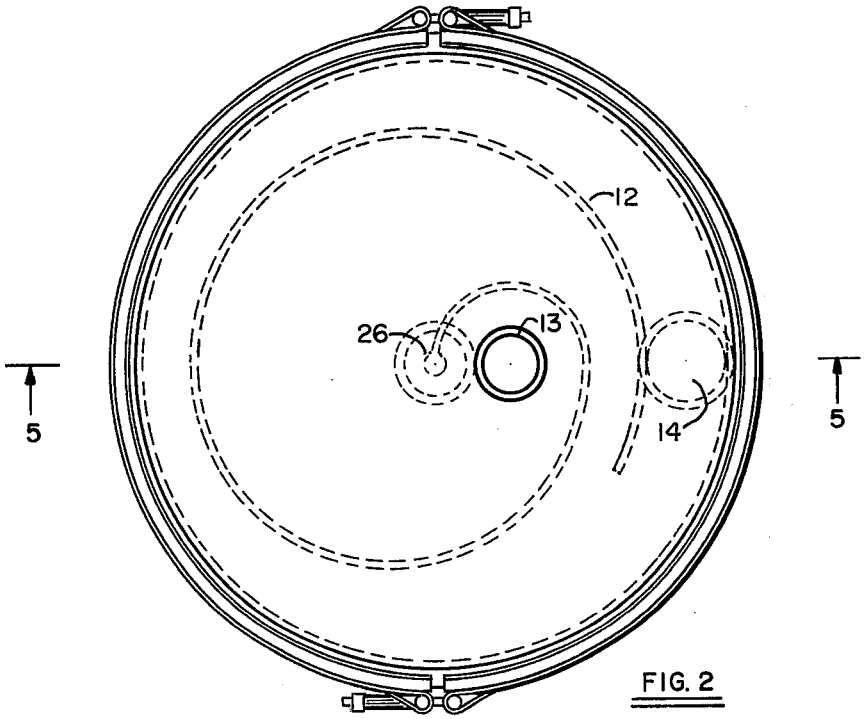
FIG. 2 is a plan view of FIG. 1 illustrating a baffle.

The objects of this invention can be achieved by driving the vibrating screen with a unique combination drive which involves an electromagnetic drive coupled to a stiff spring mounted screen assembly. Basically, the screen motion is defined by the springs which produce the desired motion as they are deflected by the magnetic drive. The resultant motion is a vibration normal to the screen surface coupled to a torsional mode. As the electromagnet attracts the screen assembly, the springs deflect in a manner such that the screen accelerates downward and twists away from a given particle. When the magnet releases, the screen moves upwards and twists oppositely. The falling particle at some point in time will be impacted by the screen and given an acceleration in an upward and forward direction. At the top of the cycle the screen again starts it downward cycle. Any point on the screen surface follows essentially a helical motion and the vibration in a directional normal to the screen surface is the same at any point in the screen surface. This prevents the formation of a zone or zones of low vibration as can so readily occur under some other methods of driving the vibration screen.

A further unique characteristic of the invention lies in the location of the torsional node. As indicated, the springs impart a torsional mode to the screen movement. The center of rotation or node of this movement lies at some point within the volume enclosed by the vibration of the screen. Under these circumstances the particles will be given a motion which lies in some path around this node. For example, if the node is at the center of the screen the movement of the particles will be in some form of spiral path around the node.

If the material to be separated, for example, a solid suspended in a liquid, is fed to the node at the center of the screen, primary filtration occurs at this point. For convenience, it can be considered the primary screening area. In theory, solid particles at the center of rotation should have only a directional movement normal to the screen surface. In actual practice these will be forced off the center by collisions and by stray currents. As soon as they leave this center they will gradually move out in some spiral movement toward the rim of the screen. These particles will move over the screen where additional filtration or classification is provided on the sections of the screen surrounding the node. The coarser particles, or retentate, will progress in a spiral path around the node and eventually will reach the screen rim or exit port.

Although the invention has been described in general terms using one screen, the invention is equally applicable to a number of screens. Thus, it is possible to separate or to sort out materials into several classifications by appropriate selection of multiple screens.

In an alternate arrangement to the above process the screen is fitted with a scroll shaped wall attached to the screen which can act as a baffle and prevent the feed and retentate from short circuiting and going directly from the primary feed area to the exit port. With this arrangement the residence time on the screen can be controlled and a much cleaner separation achieved. The passage between walls is sufficiently wide to permit the solids to pass freely around the passageway. The screen motion induces motion of the retained materials in an essentially circular path while the baffle directs the retained material around and continuously in a radially outward path where the material can be discharged at one or more points on the rim. In order to prevent impedance to the retained material the baffle is driven with the screen and has a resilient elastomer contacting the screen to prevent screen abrasion.

The high acceleration of the screen in a direction normal to the screen surface prevents blinding. Any particle on the screen surface will be accelerated at such a rate that the adhesive forces between the material of the screen and the solid particle in most cases will be exceeded. Governed by the springs and the driving force the screen movement will cause the freed solid particle to acquire a fresh resting place on the screen. Thus, blinding of the screen will be eliminated.

Occasionally, if increasing the acceleration of the screen is impractical and if blinding of the screen is particularly troublesome, antiblinding devices can be used. These can be of a number of types but a simple yet effective method is to use a series of rubber balls supported on a porous screen or porous plate beneath the screen. The porous plate, driven in conjunction with the vibrating screen, bounces the balls against the bottom of the screen. This additional random action prevents blinding in particularly stubborn cases. The use of balls of this type and for this purpose as applied to oscillating screens is old in the art. It is particularly effective, however, where the screen motion is normal to the screen surface at the points rather than oscillating back and forth in its own plane.

As indicated, the vibration of the screen, with its high normal acceleration of at least 1 g, will in most cases overcome the adhesive force between the particle and the screen material. In those cases where these forces could be high it is possible to alter these forces by using a fine coating on the screen of some material in which the adhesive forces between the particles and the screen are reduced. Alternatively, the screen can be made from a material which has low adhesive properties to the particles. The high speed vibrating action of the screen is equally effective in the transfer of liquid through the screen. This is especially true in the case of viscous liquids and for those liquids with relatively high surface tensions. The high speed of the vibrating screen creates continually new interfaces and transfer of liquid is accelerated. As the screen wires accelerate, the liquid tends to cavitate and impact the screen, alternately. This aids gravity in overcoming the screen's resistance to flow.

The torsional component of the vibration provides the tangential travel impetus to the solids. In each complete vibration cycle the screen drops from under the solid particles and moves backward in respect to the flow direction of the solid. When the screen begins to accelerate upward it reimpacts the solids and the solids move upward and torsionally with the screen until they leave the screen at some point as the screen decelerates. This provides a repetitive series of directed impacts which drives the solids forward between the baffles.

In addition to the directed impetus provided by the torsional component of the vibration the torsional component provides a rolling motion to solid particle. This motion, together with vibration normal to the screen surface, provides fresh surfaces for removal of liquid or fine solid material as dust. The torsional component as indicated, exerts a shearing action at the material-screen interface which is proportional to the distance of the interface from the center of the torsional vibration.

Figure 1:
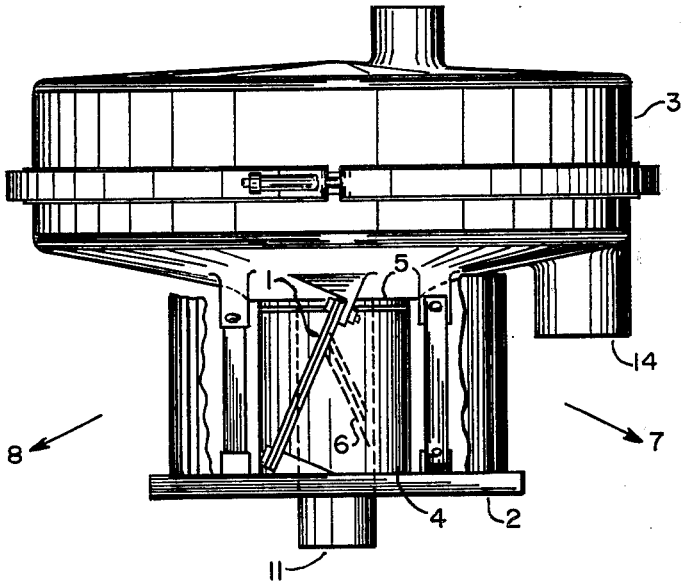
FIG. 1 is a frontal view of a vibrating screen showing an arrangement of the springs and electromagnetic drive.

The coupled torsional-normal vibration is controlled by the forces driving the screen in the normal direction and the interaction of these forces with the coupled torsional springs. Thus, with an alternating force the spring action controls the motion. The type of springs, the number and the location and arrangement of the springs controls the screen motion. One such arrangement of springs and driver is shown in FIG. 1. In this arrangement one end of a spring 1 such as a leaf spring which has some preferred directional movement under an applied load is attached to a reaction mass 2 while the other end is attached to the screen mass, in such a manner that the screen assembly twists as it deflects.

Figure 5:
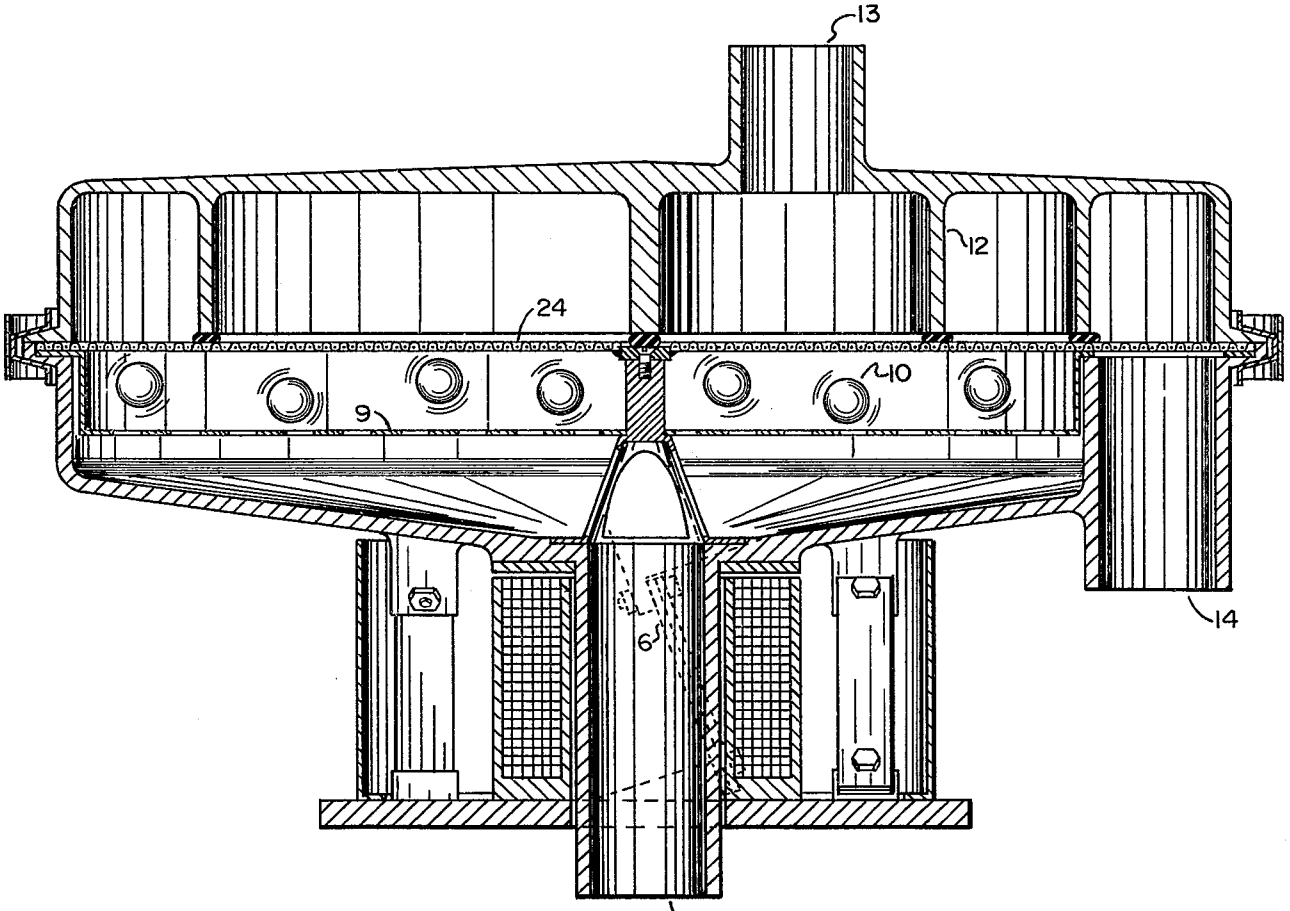
FIG. 5 is a sectional front view taken as indicated by the line 5—5 in FIG. 2.

Another similar spring 6 is attached in a similar but paired manner on the opposite side of screen mass 3. Screen mass 3 comprises the screening, flow directing, and collecting components of the mechanism. These include, as in FIG. 5, feed port 13, baffle 12, retentate exit port 14, screened material exit 11, antiblinding balls 10, and open mesh ball cage 9. Referring to FIG. 1, the actuating force is furnished by the electromagnet 4 acting on the suitable plate 5. As the load is applied by energizing electromagnet 4 the springs 1 and 6 deflect. Spring 1 will deflect in the direction 7 shown while the opposite paired spring 6 will deflect in direction 8.

The vibration is induced by a cyclic force field which deflects the springs. This may be induces mechanically, pneumatically, electrically, or hydraulically. A preferred method utilizing electrical power is the one illustrated in FIG. 1.

The springs define the direction and displacement of two points on the screen mass 3, with respect to reaction mass 2. Since the screen mass is essentially rigid, definition of motion at two of its points defines it motion at all points. With the springs as shown, working at equal angles to the planes of the masses, and simultaneously traversing equal distances perpendicular to themselves, the screen mass 3 rotates with respect to 2 about a node located along lines perpendicular to the actual directions 7 and 8 and passing through the attachment points of 1 and 6 to mass 3. Since the springs are equal, the node is midway between them. This rotation is superposed upon a translation of mass 3 toward mass 2. During the total motion, each point on screen mass 3 moves in a helical path with respect to 2. By alternately attracting and releasing the plate 5 with electromagnet 4, using alternating current through electromagnet 4, this helical motion is achieved at twice line frequency. Alternatively, by using a diode in the line in series with the coil, a modulated dc will induce oscillation at line frequency. The motion is induced by a force field in which electromagnet 4 varies its attraction to plate 5. The amplitude of motion depends upon the two masses, 2 and 3, the applied force field and the stiffness of the springs. The springs and masses are such that the system's natural frequency is between 70 and 150 percent of the impressed force frequency. When the driving frequency is in the 50 to 60 hertz range, for example, this defines a system with a high effective rigidity (small deflections under partial g-tilt or ship motion loads), but a capability of multiple g-accelerations when excited by the electromagnet. Although two springs are sufficient to produce the desired motion, stability of the screen to forces acting in other directions will not be good with only two springs. Thus, to prevent tilting of the screen under forces such as those of a rolling or pitching ship resulting from various wave actions at least three springs will be required to define a stable arrangement.

The use of multiple springs requires that certain relations be maintained between them to establish the proper screen motions. These are defined as follows:

1. Movements of all points on the screen mass in a direction normal to a given plane in the screen mass are to be equal to one another at all times.
2. A torsional oscillation about an axis normal to the plane is to be maintained.

To achieve these motion and to prevent binding the following conditions are necessary:

1. Each spring must deflect such that its component parallel to a given plane of the screen mass is perpendicular to the line from the node axis to the spring's point of attachment to mass 3.
2. Each spring must be arranged such that when it deflects a give distance normal to a given plane, its deflection parallel to that plane is directly proportional to the distance between the spring's point of attachment to mass 3 and the node.
3. The secondary twists or stretching effects on the springs must be considered. The spring widths and mounts must be compliant enough to permit the desired primary deflections without binding. For example, when masses 2 and 3 deflect, they must approach one another, or one mount must comply, or the spring will load up as a tension bar. Similarly, as the two masses twist, the spring must twist without binding.

For example, for springs arranged as in FIG. 1, this indicates that the cotangent of the angle between displacement 7 and the screen plane is to the cotangent of the angle between displacement 8 and the screen plane as the distance from the torsional node axis to the attachment point of spring 1 is to the distance from the node axis to the attachment point of spring 6 to the mass 3.

Any number of springs can be used without binding, so long as these relations are maintained.

Generally, pairs of opposed springs are preferred. The number of springs is not limiting, but as the number is increased beyond four the difficulties of arranging independent springs in space increase. For this reason the least number of springs to give the desired motion is preferred.

Although FIG. 1 illustrates the case where the torsional node is in the center of the screen, this is not limiting. As long as the torsional node axis passes through some point on the screen surface the particles will be driven in some path across the screen surface and tend to circulate around the node. In some cases some alternate path may be preferred. Appropriate adjustments to the design and location of the baffle could be made to take maximum advantage of the particular system.

The arrangement of FIG. 1 shows the reaction mass and screen mass vertically offset and the springs arranged between the two masses.

Figure 3:
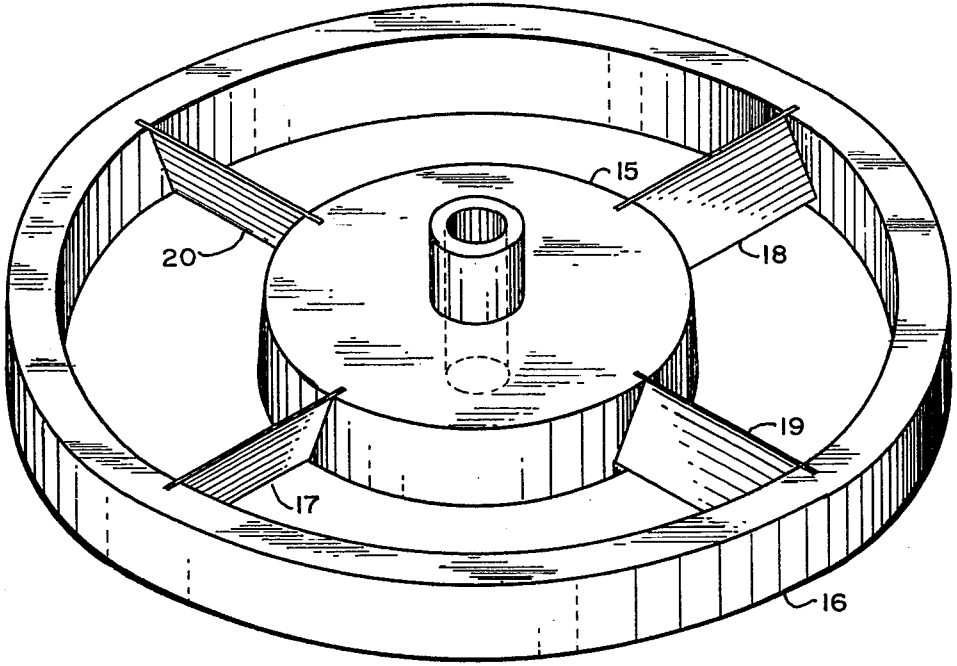
FIG. 3 is a perspective view illustrating an alternative arrangement of the screen mass and reaction mass.

This is not a limiting configuration. The masses may be at any level with respect to one another so long as the springs provide proper deflections. FIG. 3 shows one possible alternate. The screen mass is at the center. The springs are like wheel spokes, angled to define the proper relative motions, and mounted with either their inner or outer ends in compliant clamps.

In this embodiment of the invention the screen mass 15 is attached to the reaction mass 16 by springs 17 and 18. Springs 19 and 20 could be added to give additional stability to the screen as discussed earlier. Again the type of springs is immaterial as long as it has some preferred directional movement under load and as long as it can be attached in such a manner that twisting movement is imparted under load. Further, if paired springs are used it is preferred that arrangement of the springs should be such that twisting will occur in a paired opposite direction. Thus, it is clear that if some load is applied to the screen surface, for example, by a suitable electromagnet located below the screen, the screen will move down and away from a given particle and then upwards and forward at the end of the cycle. Other arrangements of springs, masses; force field and directions are possible within the scope of the invention.

The movement normal to the screen surface will be controlled by the force field of the electromagnet and by the modulus of the springs. Since the amplitude of the movement and the frequency of the forcing function will control the acceleration of the screen and particles, these forces in large part govern the ability of the screen to function efficiently and to prevent blinding. It should be noted that the movement parallel to the torsional axis is the same at all points on the screen surface. However, it should be noted that the movement resulting from the torsional forces is related to the position on the screen and is dependent upon the distance of a point from the torsional node. This effectively relates particle travel to distance from a node, and defines residence time.

As indicated, these factors which influence screen movement can be varied widely, and the invention can be practiced over wide limits and is dependent in large part on the characteristics of the materials to be separated as well as the properties of the screens which are used. Thus, there are many combinations and permutations which are apparent to those skilled in the art.

The use of a scroll type baffle or guide 12 as in FIg. 2, is an important adjunct to the success of this invention. As indicated, the invention can be practiced in the absence of a guide or baffle. However, improved efficiency by preventing short circuiting of feedstock from the screen entrance area to the exit port is effectively insured by the use of a scroll. For example, when used on shipboard, a properly designed baffle, since it guides a spiral flow of material around a screen to the exit port, prevents short circuiting as the ship rolls.

Figure 4:
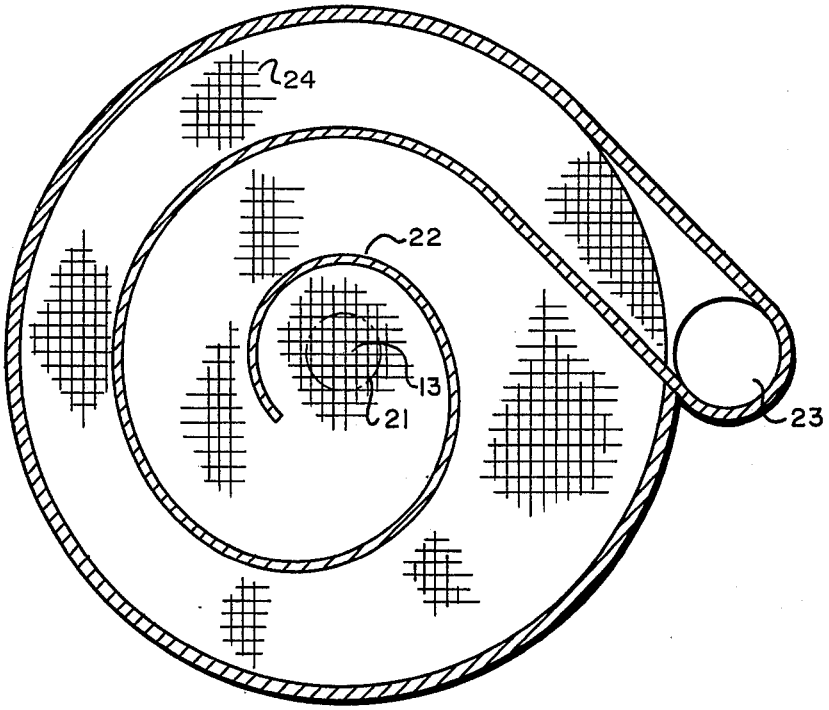
FIG. 4 is a sectional plan view similar to FIG. 2.

As indicated, the scroll baffle can take many forms. For screen with torsional nodes in the center an example of an effective baffle is shown in FIG. 4. In this instance the torsional node would be in area 21 which is also the entrance of the feed 13. Baffle 22 is designed in such a manner that material reaching exit port 23 will travel over a major portion of screen 24. In a similar manner the exit port 14 can be arranged within the screen confines as shown in FIG. 2. In this arrangement material can bypass the port and make a second circuit around the screen. Many other arrangements are possible including one in which the scroll is an integral part of the node.

As previously indicated, the screen motion induces circulation of material about the torsional node. When the material to be moved is particulate, and each section moves independently of each other section, it makes little difference where the end of the baffle spiral is. Particles can pass it on both sides, without mutually interfering. Those on one side travel to the exit. Those on the other side move freely in the entry zone and after full circle are given a second opportunity to pass the baffle. With stringy materials, or fibers, such independence does not exist. If one part of a fiber is on one side of the baffle, and the other part on the other side, the motion of the screen induces the fiber to drape itself around the baffle and resist dislodging. If, however, the baffle end is at the torsional node, this effect can be negated. With respect to the node, all parts of the fiber tend to circulate either clockwise or counterclockwise (clockwise in FIG. 2) and the fiber would pivot around the node, clearing itself from a baffle which terminates at that point.

FIG. 2 is also an illustration of a baffle which terminates at the node. In the preferred manner using this system feed would be admitted through 13. Item 26 corresponds both to the node and the baffle end. Any fiber or stringy material which is draped around 26 will pivot clockwise and undrape itself from the baffle end.

In addition to variations in the design of baffles, it is possible to use steps, inclined slopes or weirs in the passageways included between the baffles. Since the force moving the particles increases with increasing distance from the node, such modifications should be located at some distance from the node.

Since so many design arrangements are possible, it is important to note that the location of the feed, the exit ports and types and the design of the baffle, must be coordinated with the location of the torsional node. Since the location of this node must be in the effective surface area of the screen if a spiral baffle is to be effective, this is an important factor in screen efficiency.

The use of mechanical drives for vibrating screens has frequently resulted in poor operator working conditions. The high noise level and the severe vibrations transferred to the equipment foundations and building structure can cause severe damage to the health and morale or workers exposed for long time periods. In general, by mounting the unit base to its support with soft mounts, the vibration transferred to the support can be reduced. Nevertheless, under certain conditions it is desirable to reduce these effects still further.

In the preceding description, all of the motions have resulted from interacting screen mass 3 with reaction mass 2, without regard to support of mass 2 from ground. Typically, mass 2 is supported from ground by compliant mounts, with spring constants soft enough to transmit small loads to ground as reaction mass 2 oscillates. These forces, small compared to those between 2 and 3, are still large enough in some cases to distrub the structure supporting the screen, to an unacceptable degree.

Figure 6:
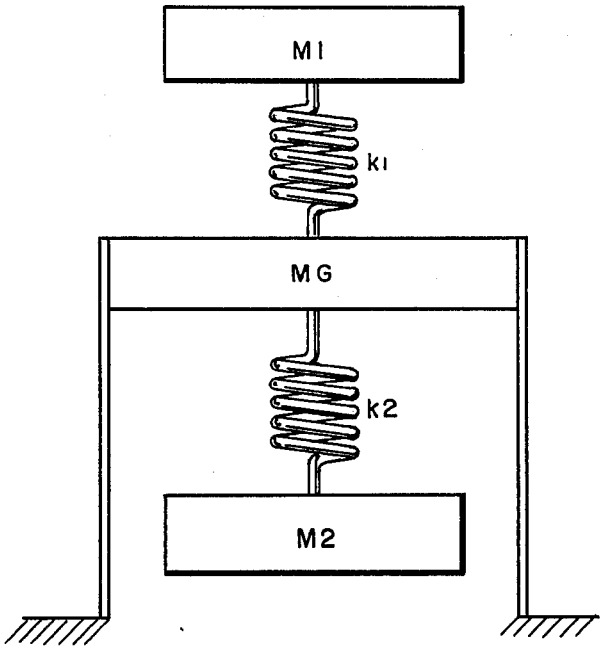
FIG. 6 is a diagrammatic illustration of a two mass, single spring system.
Figure 7:
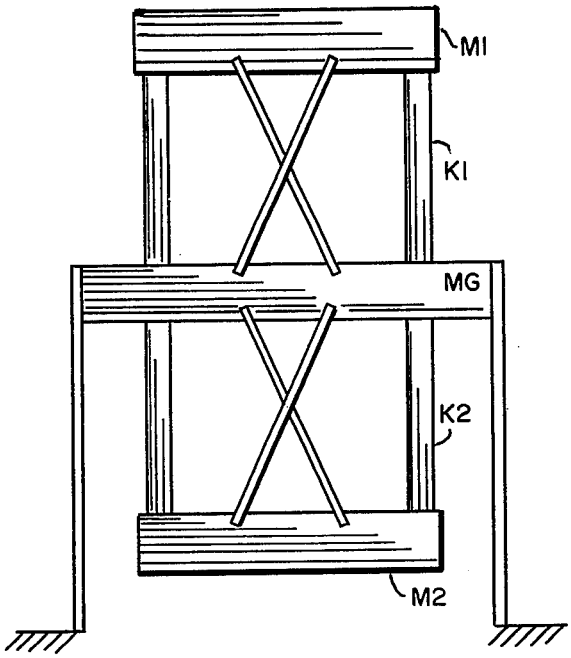
FIG. 7 is a diagrammatic model of a three mass system.

Such disturbance is eliminated by using the following technique:

Consider the system as a two mass, single spring system as in FIG. 6, in which whenever the screen mass is moving clockwise and downward, the reaction mass is moving counterclockwise and upward, and vice versa. The motions with respect to ground are strictly defined such that the composite system has no change in the vertical position of its center of gravity, nor any angular momentum change during the vibration, since neither force nor torque is applied externally to the system. Therefore, on each spring a point exists which has no motion with respect to inertial space as a result of the vibratory disturbance. The structure supporting the device can be attached to the springs at this point, with the property that this structure will not transmit any disturbance to ground. The vibration mode is that of a two mass system, supported at a node of its motion:

In practice, this structure may be actually attached to continuous springs, or the unit may be arranged with three effective masses and two spring sets as modeled in FIG. 7. $M_1$ and $M_2$ are equivalent to the screen and reaction masses respectively. $k_1$ and $k_2$ are two spring rates related as follows:

$$\frac{k_1}{M_1} = \frac{k_2}{M_2}$$

In addition, the system is driven at 70 percent to 150 percent of the frequency defined by:

$$\omega_n = \frac{k_1 k_2 (M_1 + M_2)}{M_1 M_2 (k_1 + k_2)}$$

The induced mode of vibration is then equivalent to $M_1$ and $M_2$ acting as a two mass system. The third mass, Mg represents the structure supporting the system to ground, and transmits no significant disturbance, if properly designed. An example of such a construction is shown in FIG. 7.

The spiral movement of particles on the screen, together with appropriate baffles, and vibration, is particularly valuable for shipboard use, since as roll and pitch tend to slide material across the screen, the baffles limit its excursion. Preferably, the exit port and the torsional node should be aligned fore and aft on the ship, since fore and aft disturbances from pitch are generally lower than athwartships roll effects.

In order to further describe the invention, the following examples are submitted by way of illustration only, and are not to be construed as limiting the invention in any manner:

EXAMPLE 1

A vibrating screen, driven at 60 Hz by a diode-clipped 60 Hz line voltage with an electromagnet and plate, in which the screen mass consisted of a housing with inlet port, liquid exit port and solids exit port, spiral baffle, 140 mesh screen, with elastomer anti-blinding balls arranged essentially as in FIG. 1, with a torsional node at the screen center.

The unit, with an effective screen area of 150 in$^2$, and 2inches wide paths between baffle turns, was used to filter raw sewage at rates up to 15 gallons per minute. During the course of several tests, at least 5,000 gallons of sewage with an average suspended solids level of approximately 300 Mg/liter, was treated, and approximately half its suspended solids removed. Solids were removed at a dryness of 5 to 15% dry solids. Blinding was not experienced during any run.

The vibration amplitude was approximately 0.015 inch normal to the screen, and the torsional component, at a 9 inches radius from the node equal to approximately 0.060 inch.

EXAMPLE 2

On a machine similar to FIG. 1, paper plant effluent containing long and short fibers as well as suspended solids was processed at rates up to 10 gallons/minute. The effluent was virtually free of long fiber components, which were removed by the screen and released from the machine at drynesses averaging 5 to 6% solids. Approximately a thousand gallons was treated without signs of blinding or buildup on the screen.

EXAMPLE 3

A machine similar to FIG. 1, with spiral scroll, subjected to tilts of ±45° at a frequency of one-twelfth cycle per second was designed for shipboard use. In ground based testing, the screen-baffle arrangement filtered sewage averaging 1,000 Mg/liter solids without blinding or short circuiting wet sewage to the output pipe. The relatively stiff, tuned, mounting spring system prevented any significant shift or binding of the action under the ship motion type loading.

What is claimed is:

1. A process for screening materials by means of a substantially planar screen having an entrance surface facing generally upwardly and an exit surface facing generally downwardly comprising the steps of:

a. feeding the materials onto the entrance surface of the screen, b. vibrating the screen by producing a translational oscillation of the screen in directions normal to the plane of the screen and a torsional oscillation of the screen about an axis normal to the plane of the screen, so that each point of the screen moves in a helical path, the translational oscillation of the screen being such that the acceleration of the screen normal to the plane of the screen is at least 1 g (32.2 feet/second$^2$) during some portion of each vibrational cycle, c. utilizing the torsional oscillation of the screen to transport screen retentate to an exit port disposed generally in the plane of the screen at a location spaced from the axis of torsional oscillation, d. collecting the screen retentate at the exit port, and e. collecting the screened material below the exit surface of the screen.

2. The process according to claim 1 in which the vibrating of the screen is accomplished by applying a cyclic force to the screen while constraining the screen motion to a helical path.

3. The process according to claim 2 in which the cyclic force applied to the screen is a cyclic magnetic force.

4. The process according to claim 1 in which the screen retentate is transported in an essentially circuitous path to the exit port.

5. The process according to claim 1 in which the axis of the helical paths defining the motion of all points of the screen passes through the screen.

6. The process according to claim 1 in which the screen retentate is transported to the exit port in a predetermined path by directing the screen retentate along said path by means of a scroll baffle.

* * * * *

UNITED STATES PATENT AND TRADEMARK OFFICE

CERTIFICATE OF CORRECTION

PATENT NO. : 3,932,442

DATED : January 13, 1976

INVENTOR(S) : John Kennedy Salmon et al.

It is certified that error appears in the above-identified patent and that said Letters Patent are hereby corrected as shown below:

First page, Col. 2, second paragraph of ABSTRACT should be cancelled;

Col. 1, line 53, "extends" should read --extend--;

Col. 4, line 14, "the points" should read --all points--;

Col. 5, line 15, "induces" should read --induced--;

Col. 5, line 22, "it" should read --its--;

Col. 5, line 67, "motion" should read --motions--;

Col. 6, line 6, "give" should read --given--;

Col. 8, line 29, "or" should read --of--;

Col. 8, line 41, "distrub" should read --disturb--; and

Col. 9, line 10, "

$$\omega_n = \frac{k_1 \; k_2 \; (M_1 + M_2)}{M_1 \; M_2 \; (k_1 + k_2)}$$

"

should read --

$$\omega_n = \sqrt{\frac{k_1 \; k_2 \; (M_1 + M_2)}{M_1 \; M_2 \; (k_1 + k_2)}}$$

--.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*